US005687514A

United States Patent [19]

Gillispie

[11] Patent Number: 5,687,514

[45] Date of Patent: Nov. 18, 1997

[54] ADJUSTABLE CURB WITH FLASHING

[76] Inventor: John Joseph Gillispie, 6532 Joshua Tree, Orange, Calif. 92677

[21] Appl. No.: 582,277

[22] Filed: Jan. 3, 1996

[51] Int. Cl.[6] ..... E04D 1/36

[52] U.S. Cl. ..... 52/58; 52/200

[58] Field of Search ..... 52/58, 200, 308, 52/219, 656.1

[56] References Cited

U.S. PATENT DOCUMENTS

| | | | |
|---|---|---|---|
| 2,956,495 | 10/1960 | Sublette | 52/58 X |
| 5,016,406 | 5/1991 | Calam et al. | 52/58 |
| 5,297,371 | 3/1994 | Borgletto | 52/200 X |

*Primary Examiner*—Carl D. Friedman
*Assistant Examiner*—Creighton Smith
*Attorney, Agent, or Firm*—Curtis L. Harrington

[57] ABSTRACT

A curb is formed of a base portion and an upper portion which fits peripherally over the base. A horizontal clearance between the vertical walls of the base and upper portion of the curb is distributed about the periphery of the curb, to enable the upper portion to be angularly displaced with respect to the lower portion, and to encompass complex as well as linear displacement. The act of leveling the curb is combined with the act of fixing the base with respect to the upper portion which can be accomplished with a simple level and the addition of screws joining the base the the upper portion. A pitch pan area for drainage of water from inside or under the equipment is supported by the curb. The upper partially flat and curved metal structure of the upper portion of the curb provides a surface for gaskets for improved sealing.

15 Claims, 6 Drawing Sheets

21
23
59
5
53
57
33
29
47
49
55
43
31
33
49
5
45
41
37
51
27
29
39
25
35

ADJUSTABLE CURB WITH FLASHING

FIELD OF THE INVENTION

The present invention relates to the field of equipment and structures for installing and supporting heating, ventilating and air conditioning equipment, and particularly to heat pumps used for both heating and air conditioning. The curb enables quick and easy installation and eliminates the use of special carpentry which is otherwise necessary to provide a custom made installation for the support of each piece of equipment to be supported.

BACKGROUND OF THE INVENTION

Support structures for heating, ventilating and air conditioning equipment are widely varied. In some instances the equipment rests on cement slabs installed next to a building. However in larger buildings requiring multiple numbers of units, it is both practical and efficient to mount the units on the building roof or other horizontal support structures.

In the usual case, a support must be built up from the roof to support the equipment at a height of several inches above the roof. In most cases, a carpenter must be called upon to custom build the support before the roofing material is installed. The carpenter builds this support mostly by trial and error, one piece at a time. Most installations involve a rectangular support for a correspondingly rectangular piece of equipment to be supported. Where the roof is sloped in one direction, evenly along a pair of the edges of the support to be built, the carpenter's job is slightly complicated. However, where the slope is diagonally across the support, the job becomes extremely complex, requiring either a thorough computation or several trial-and-error construction attempts with accompanying waste in materials and carpenter time.

The goal of providing a platform for supporting a piece of equipment has several objectives. First, the support should provide a level surface for the equipment. The equipment is designed to operate in a level state, and this includes handling water from rains and condensation. A second goal is to provide access to the building through the curb, but without breaching the building's protection from the elements, particularly water. As a result, curbs which are custom built must also provide some accommodation to the roofer.

Most curbs are about a foot or slightly less in height to accommodate rolled roofing to be attached along the upper part of the curb to form a curved sloping drainage surface. In the conventional design, the sloping portion of roofing is all that stands between water runoff and leakage into the space between the support and the roof underlayment. If the curved portion of roofing is stepped upon, a hole can easily be torn in the roofing, breaching the integrity of the roof.

The conventional installation then involves a carpenter and a roofer as well as the HVAC professional who must then mount the equipment and complete the ventilation connections. Whether multiple or single units are to be installed, two of these three tradesmen must stand in line waiting for the previous portion of the support to be completed. The roofer awaits completion by the carpenter. The HVAC professional must await completion by the roofer.

In addition, it is often necessary that the top of the support unit also form gasket which will oppose a gasket surface in the equipment to be mounted atop the support. It is difficult and impractical to impose upon the carpenter the additional specifications required by the equipment. Further, where there is a mis-communication or variation, the carpenter is not always around to re-build corrections when there is an interface problem between the equipment and the support.

Another consideration which drives the final configuration of the equipment support is the necessity to make a final change in direction or a change in cross sectional opening of the ventilation ducts. In some cases the curvature of the ventilation ducts, or the extra lengths added by the final adapters may dictate the final height of the resulting equipment support. The final height requirements may not even be known at a time when the carpenter begins work. Subsequent mismatch requires either a carpenter's re-build or some tricky and difficult duct alterations.

In the event of a retrofit, the above problems are magnified. As an example, a particular piece of equipment may be broken beyond repair and need to be replaced. If a replacement of exact dimension as before cannot be found, the supporting curb would have to be modified. Modification of the curb would again involve a carpenter, and a roofer to re-roof the portions immediately surrounding the curb. For the change of a single piece of equipment, the necessity to involve all three tradesmen will dramatically increase the cost. Failure to involve all three will risk a leaky roof, a defective curb, and perhaps damage to the equipment.

As is apparent from the forgoing, what is needed is an equipment support, or skirt, which can be easily installed in a way which will eliminate involvement by a roofer or a carpenter. The installation of the desired curb could be done with minimum preparation and bother both in an original and retrofit installation. The needed curb and method should facilitate leveling, even in a complex environment where a slope line or slope lines extend across the curb.

The needed curb should facilitate duct separation, sealing and access. The needed curb should provide superior support and eliminate as nearly as possible the opportunity for leakage surrounding the curb. The needed curb should also handle full rain and condensation runoff in as expeditious a manner as is possible.

SUMMARY OF THE INVENTION

The curb of the present invention is formed of a base portion and an upper portion which fits peripherally over the base. A horizontal clearance between the vertical walls of the base and upper portion of the curb is distributed about the periphery of the curb, to enable the upper portion to be angularly displaced with respect to the lower portion. Angular displacement can be complex as well as linear. The act of leveling the curb is combined with the act of fixing the base with respect to the upper portion which can be accomplished with a simple level and the addition of screws joining the base the upper portion.

The upper portion includes a pitched pan area for drainage of water from inside or under the equipment supported by the curb. The upper partially flat and curved metal structure of the upper portion of the curb provides a surface for gaskets. In one embodiment, a divider is provided which is displaceable across the central upper opening in order to form separate, spaced apart openings in the upper portion of the curb to accommodate similarly spaced apart ducts.

The inventive process enables each corner of the upper portion to be secured to the base with a single screw, one corner at a time. The first corner would be fixed based upon desired height. The second corner would be secured only after it and the first corner were leveled. The third corner would be secured only after it and one of the first and second corners were leveled. The fourth corner would form a fine adjustment of its own weight against the other leveled corners. The process could also be accomplished with the use of shims where the upper portion was completely leveled before any of the attachment screws were added.

The curb of the present invention has a base with a wide horizontal flange. This facilitates its installation over roofing material along with the use of a sealant. The horizontal portion of the flange can be screwed or bolted into place to provide further clamping force on the sealant. In this manner, no carpentry or roofing is necessary. In addition, the curb of the present invention also has an accommodation space for wooden strips, where roofing is to be attached in the conventional manner. The wooden strips can be pressure fit into spaces on the upper portion and have roofing material nailed to the strips in a conventional manner.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
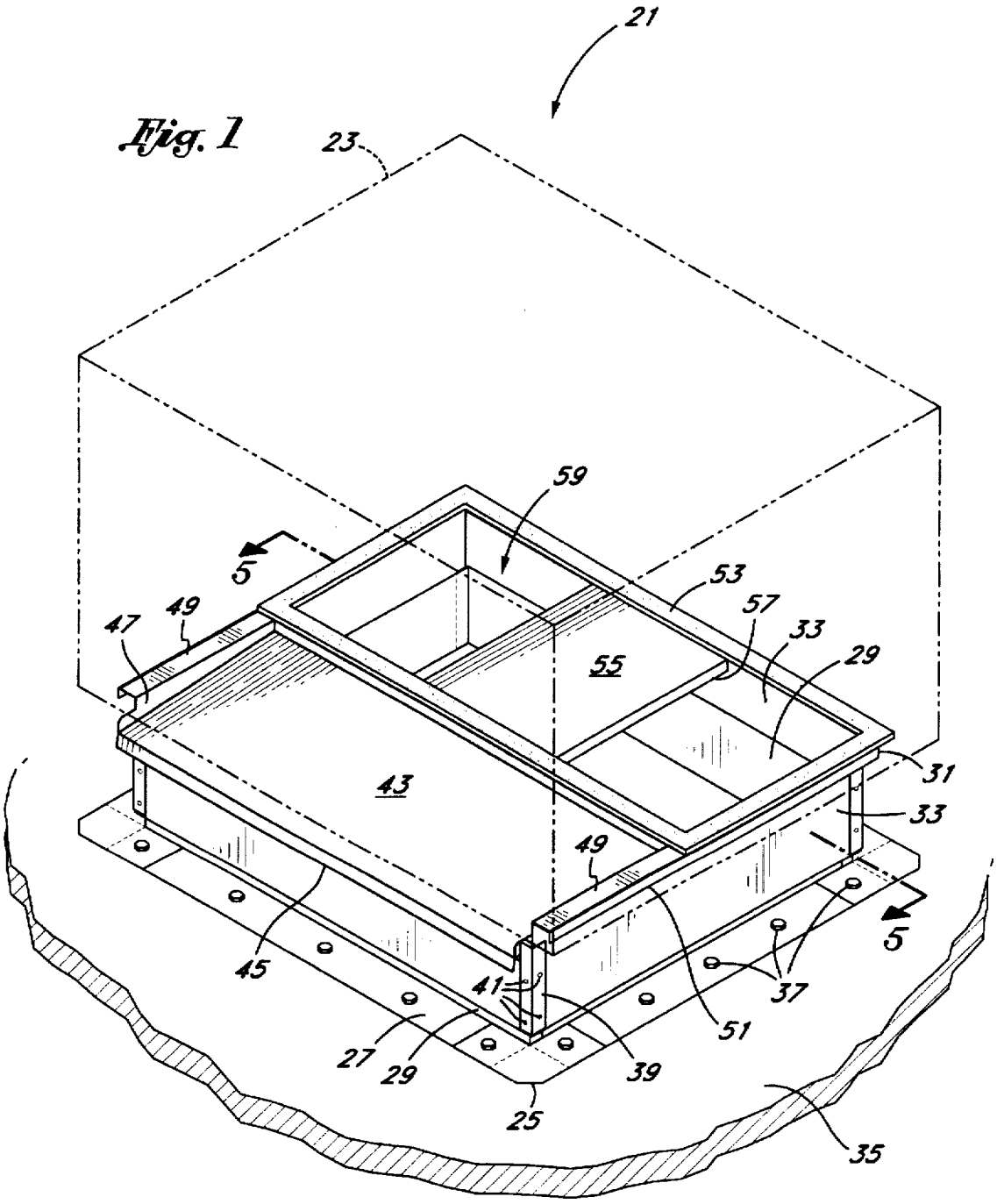
FIG. 1 is a perspective view of the adjustable curb with flashing of the present invention illustrated installed on a section of roofing and with a ventilation unit shown in phantom atop the curb.

The description and operation of the invention will be best described with reference to FIG. 1. FIG. 1 is a perspective view of a curb 21 of the present invention. Over the curb, in phantom, is a rectangular representation of the equipment which the curb 21 would support, and will hereafter be referred to as equipment 23. Equipment 23 is ideally a piece of heating, ventilating or air conditioning equipment. It may be a heat pump which performs both heating and air conditioning service.

The curb 21 includes a base portion 25 having a horizontal flange 27 and a vertical wall portion 29. Curb 21 also has an upper portion 31 which includes a vertical wall portion 33 and various upper structures.

The base portion 25 is shown installed on a section of roof 35 and is secured by a series of nails or screws, hereinafter referred to as screws 37 extending through the horizontal portion 27 and into the roof 35. Screws or nails are used to provide a flatter finish and to be more compatible with roofing material. Although the base portion 25 fits sealingly flat onto the roof 35, the upper portion 31 can be angularly fixed to the base portion 25 such that the upper portion 31 is level.

The upper portion 31 has reinforced corners 39, each of which have a pair of pre-drilled holes 41 on each vertical surface. These holes facilitate the attachment of the upper portion 31 to the vertical wall 29 of the base portion 25. The screws (not shown in FIG. 1) will pierce the vertical wall 29 of the base portion 25 at various placed depending upon the angle which the upper portion 31 makes with the base portion 25. The provision of pre drilled holes 41 so close to the end of the upper portion 31 will not only facilitate a strong connection to the base portion 25, but will provide a maximally one sided pivot point as screws are added as the upper portion 31 continues to be leveled during the installation process.

Note that the upper portion has a pitch pan 43 area which has a gentle but significant slope to the edge of the upper portion 31. The lower edge of the pitch pan 43 terminates in a lower lip 45. As is the case for other curved planar curved bends, the curve to the lower lip 45 helps to strengthen the curb 21. The pitch pan 43 is opposed on each side by a pair of side vertical pitch pan walls 47 which extend upwardly to form a pair of horizontally extending side rails 49 having upwardly disposed flat surfaces. Beneath the upwardly disposed flat surfaces of the side rails 49 is a downwardly disposed side lip 51, which will be shown in greater detail. Again, the curvature to form the downwardly disposed side lip 51 further strengthens the curb 21 upper portion 31 as will be shown.

The portion of the horizontal side rails 49 continue rearward and extend under and are covered by a gasket 53. The configuration of the gasket 53 is but one of thousands which would be employed to accomplish sealing between the upper surfaces of the curb 21 and the equipment 23.

Also shown in FIG. 1 is a spacer plate 55. The spacer plate has a pair of oppositely disposed downwardly extending angled portions 57. The downwardly disposed angled portions 57 fit the spacer place in an opening 59 between two opposing side edges which are covered by the gasket 53. With gasket 53 removed, the spacer plate 55 could slide in the direction of the angled portions 57 in both directions.

The spacer plate 55 serves several functions. Where the equipment 23 has bearing surfaces which would typically extend between two ducts, the spacer plate 55 will provide additional support to the equipment 23. The portions of the spacer plate 55 immediately adjacent the angled portions 57 can support lengths of gasket 53. If a pair of lengths of gasket 53 were to extend along the upper surface of spacer plate 55 and touch the lengths of gasket 53 shown in FIG. 1, the sides of the opening 59 which is divided by the spacer plate 55 would be sealed against each other. This is providing that the duct structures extending upwardly to the upper surface of the upper portion 31 formed separate airways.

The configuration thus shown enables an HVAC professional to extend the duct structures up through the opening 59, to fit flush with the upper surface of the upper portion 31. Next, a spacer plate 55 of proper size to fit within the space left by the two duct structures is added, along with its associated gasket structures. The result achievable is a finished structure which merely awaits placement of the equipment 23. Even where the equipment 23 has abbreviated length duct structures which would fit into the subdivided opening 59, the installer can, in some cases, rely on the gasket material for sealing. Thus, the placement of the equipment 23 atop the upper portion 31 of the curb 21 may be all that is needed to complete the ducting operation.

By enabling the HVAC professional to complete the duct structures in an open environment, he can insure that a better seat and seal is made in the structures extending below the upper surface of the curb 21. Typically the duct structures will involve reduction fittings, curve fittings, and other complex fittings which have a greater number of interconnects per unit length. These greater number of interconnects must fit well together and are typically the most difficult to form and fit together, especially where a major change in direction occurs. Having the ability to reach within and manipulate these structures to their final configuration is most advantageous.

One conventional alternative is to either put the equipment 23 in place on a conventional curb and attach the duct structures from below. Another conventional alternative is to assemble the duct structures and fit the equipment 23 onto the duct structure as the equipment is emplaced on a conventional curb. This would require a gentle placement of equipment weighing several hundreds of pounds onto duct structures which are made of thin metal. The result would be strained backs or perhaps crushed duct connect structure if the placement were not perfect.

Only the use of the curb 21 as both equipment 23 support and as a finished terminus of the duct structures enables the maximum reliability, accuracy and certainty of installation. A damaged duct structure, or reinstallation, as well as the possibility of such is extremely costly. Mistakes can mean the difference between a profitable installation job and one that loses money for the contractor. The ability to produce an error free installation will also give the ability to give an advantageously low bid and still profit from the installation.

Figure 2:
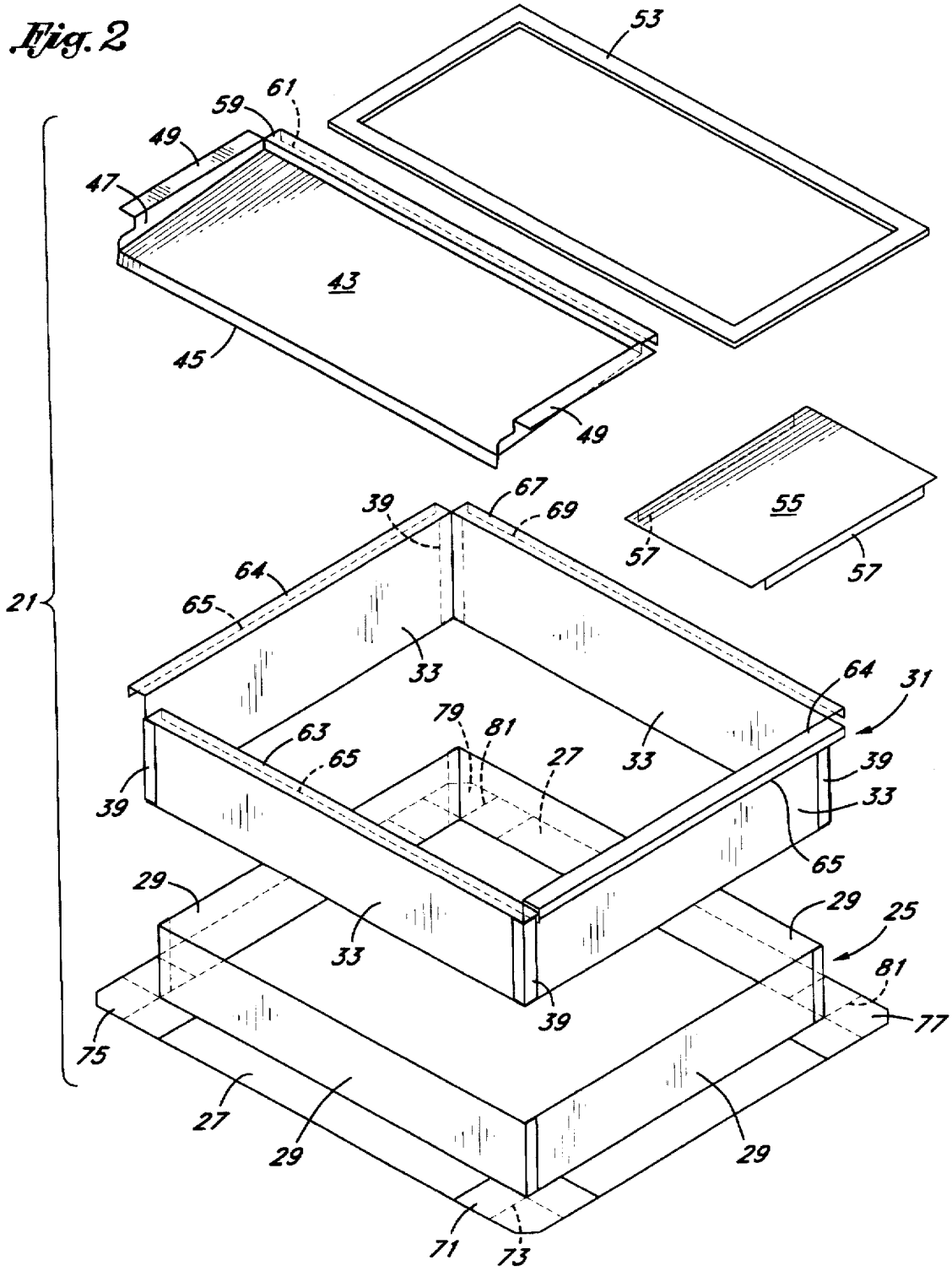
FIG. 2 is an exploded view of the curb of FIG. 1 illustrating the construction and interfitability of the component parts thereof.

Referring to FIG. 2, an exploded view of the curb 21 will enable a more detailed explanation of the individual components and their manufacture. Beginning at the top, the gasket 53 is seen as being a continuous length of material, such as a layer of cork or a composite gasket. It would be just as easy and effective for the installer to bring a roll of gasket material and form the gasket during the installation. This would enable the gasket to be built up if necessary to form a good seal.

The spacer plate 55, as has been mentioned, is not permanently attached to the upper portion 31. It is possible to carry a series of plates 55 to be employed to account for a variation in the size of the duct structures which approach the upper portion 31. The pitch pan is intended to be affixed to the upper portion 31, but may not be where the invention is to be used as a variable size system. For example, an installer may carry a large number of upper portions 31 and base portions 25 of a size slightly greater than needed to cover most jobs.

The installer may carry a series of pitch pans 43 of varying length to produce an opening 59 of various width. The installer could in turn carry a series of spacer plates 55 which to accommodate the various width openings 59, as well as the spacer plate itself having various widths to better subdivide the opening 59.

Of course, it is preferable for the pitch pan to be affixed to the upper portion 31 to add strength. However, this can be accomplished by welding at the shop, welding at the site, or by other methods of affixation available at the site. The curb 21 is intended to be both mass produced and custom produced for a given job. For example, in a situation where the equipment 23 was still in good function, but the conventional curb was rotting away, the curb 21 of the present invention could be used to replace an earlier curb.

The pitch pan is shown as having a rear rail 59 with a downwardly directed lower lip 61 for added strength. Lower lip 61 is seen in dashed line format through the rear rail 59. The side rails 49 may simply rest on the upper portion 31 or may have a downwardly directed lower lip which fits over and outside of the lower lip 51 which is an integral portion of the upper portion 31. In the latter case, the pitch pan 43 would form a stronger connection with the upper portion 33.

As is seen, the pitch pan 43 is made from a single sheet of material. It may be formed on a bending press from a pre-cut sheet of flat metal. The metal of choice should have adequate strength and be resistant to corrosion. Painting or otherwise protecting the curb 21 is always a preferred option, even though the curb 21 maybe made of anodized material otherwise protected from rust and corrosion.

With the pitch pan 43 removed, further details of the upper portion 31 may now be seen. Upper portion 31 has a front rail 63 having a horizontal surface and terminating in a downwardly extending surface 65. The front rail 63 is curved from the front vertical wall 33 rearwardly and down. This enables the lower lip 45 of the pitch pan to cleanly extend over the front vertical wall 33 and to drip moisture away from, rather than down and across the vertical wall 33.

A pair of upper portion 31 side rails 64 each have upper horizontal surfaces and lower lips 65 for increased strength. A back rail 67 has a horizontal surface and extending to a lower lip 69 shown in phantom. The curvature of the back rail 67 is outward and away from the opening 59 which would be formed with at the rear of the upper portion, between the back rail 67 and the pitch pan 43, in order to strengthen while providing added strength.

As can be seen, the vertical walls 33 of the upper portion 31 are formed as a series of four wall units. The front vertical wall 33, front rail 63 and downwardly extending lip 65 are formed of a single piece of material. Likewise, the rear vertical wall 33, rear rail 67 and downwardly extending lip 69 are formed of a single piece of material.

Side rails 64, their respective downwardly extending lips 65 and vertical wall portions 33 are each formed from a single piece of material. Each vertical wall portion 33 is then joined at its side edge and capped with the reinforced corners 39. The edges may be welded together before the reinforced corners 39 are added and welded. Depending upon the resulting strength desired, spot welding or other more structurally enforced types of welding may be desired. After the reinforced corners 39 are affixed, the holes 41 may be drilled to facilitate on site installation.

There is a clearance between the interior surface of the vertical walls 33 of the upper portion 31 and the exterior surface of the vertical walls 29 of the base portion 25. When the upper portion 31 is brought to rest around the base portion 25 when the curb is in the non-installed position, there will be a clearance between the interior surface of the vertical walls 33 of the upper portion 31 and the exterior surface of the vertical walls 29 of the base portion 25 of about one fourth of an inch on all four sides.

This clearance enables the upper portion 31 to be tilted to an angular position with respect to the base portion 25, without jamming or binding. For a given curb 21 having an uninstalled height at rest of about four to six inches, this clearance may be sufficient. Taller curbs 21 will require greater clearances. Where it is known that the tilt of the roof will occur in one direction along a direction parallel to two walls of the curb 21, the clearance between a pair of oppositely disposed sets of vertical walls 33 and 29 can be increased while the clearance between the pair of oppositely disposed sets of vertical walls 33 and 29 can be decreased.

A general evenly distributed clearance helps in complex leveling situations where the upper portion 31 may be tilted along an axis not parallel to any one of the walls 33. Where it is known that the tilt is to be more extreme, the evenly distributed clearance may approach an inch or more on each side.

Further, where it is known that an extreme tilt will be involved, the base portion 25 can be constructed with an angle between the upper edge of the base portion and the horizontal flange 27. The clearance would still be present to enable the installer to make the final, fine adjustment to level the upper portion 31.

FIG. 2 also illustrates details of the base portion 25 in terms of its construction. Beginning with the front vertical wall 29, it is seen as continuous with the front horizontal flange 27. The front horizontal flange 29 extends under a corner cap 71 and terminates at an edge 73 shown in dashed line format. A short width of the vertical wall 29 adjacent the edge 73 is bent into a right angle and overlaps a portion of the vertical wall 29 located at the side of the base portion 25 located under the side rail 64 of the upper portion 31. Similarly, a short width of the vertical wall 29 is bent into a right angle and overlaps a portion of the vertical wall 29 located at the side of the base portion 25 located under the other side rail 64 of the upper portion 31. A second cap 75 is shown at the front of the base portion 25 and opposite the cap 71.

Likewise, at the rear of the base portion 25, a rear vertical wall 29 is seen as continuous with the rear horizontal flange 27. The front horizontal flange 29 extends under both a right rear corner cap 77 and a left rear corner cap 79. The rear horizontal flange 27 terminates on either side at edges 81, which are both located under a respective corner cap 77 or 79. A short width of the ends of the rear vertical wall 29, and adjacent the edges 81 are bent forward into a right angle and each overlaps a portion of the vertical wall 29 located at each side of the base portion 25.

The relationship between the edges like edges 73 and 81 and the corner caps 71, 75, 77 and 79 are designed to provide as few places necessary for water to collect and stand. The space under cap 71 for example will be occupied with sealant or mastic applied between the roof and the underside of the base portion 25.

The curb 21 as shown in FIG. 2 is in a stage of production before the holes 41 are drilled, as well as before holes which will accommodate the screws 37 are drilled. Once the curb 21 is assembled and ready to go to the field, it may be completely assembled and pre-drilled.

Figure 3:
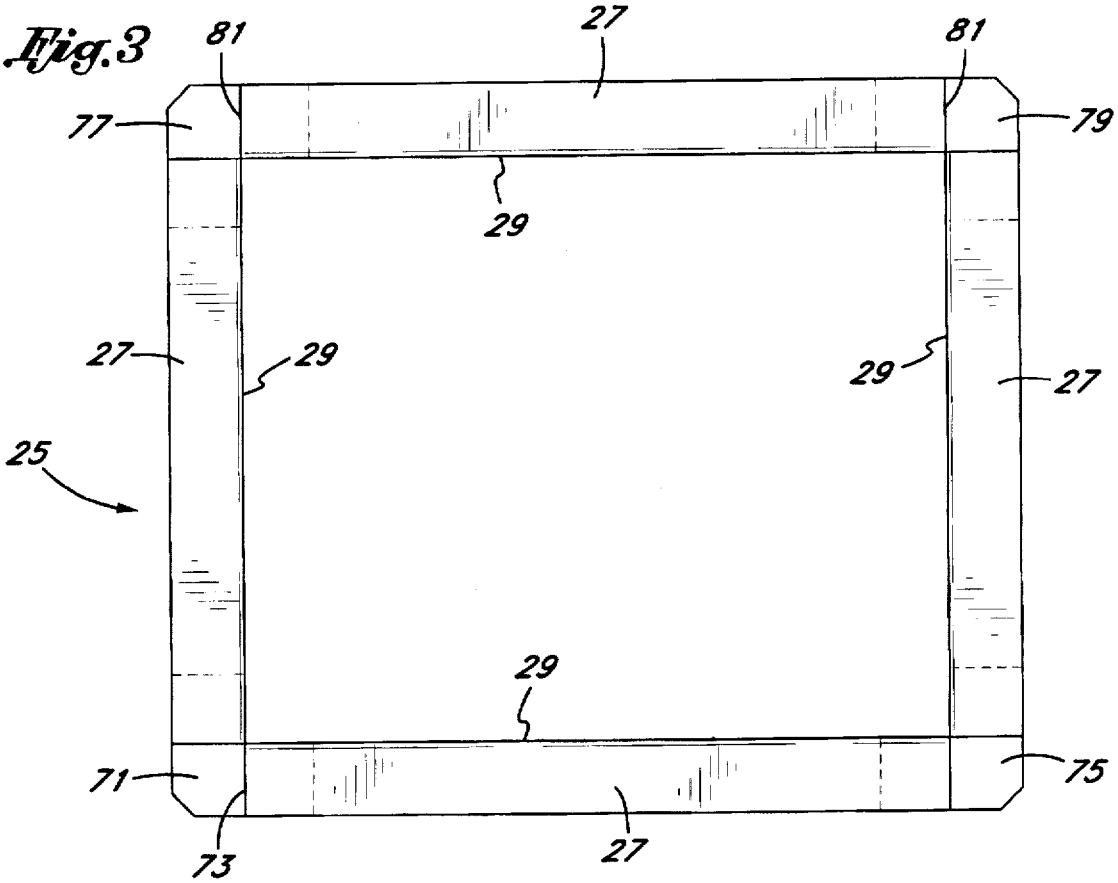
FIG. 3 is a top view of the base of the curb and illustrating the flashing which extends about the periphery of the base.

Referring to FIG. 3, an underside view of the base portion 25 is shown which illustrates the relationship of the caps 71, 75, 77 and 81 with respect to the sections of horizontal flange 27. As can be seen, the caps 71, 75, 77 and 81 provide additional material to both strengthen and stabilize the sections of horizontal flange 27. Also, if the caps 71, 75, 77 and 81 were not present, the inner corner of the base portion 25 would be immediately adjacent an open area above the roofing. The sealant or mastic engaged by the horizontal flange 27 and caps 71, 75, 77 and 81 help seal the base portion 25 against an area or section of roofing 35. Note that the edges of the horizontal flange 27, such as 81 and 73 are shown in solid line while the outermost edges of the caps 71, 75, 77 and 81 are shown in phantom, since FIG. 3 is an underside view.

Figure 4:
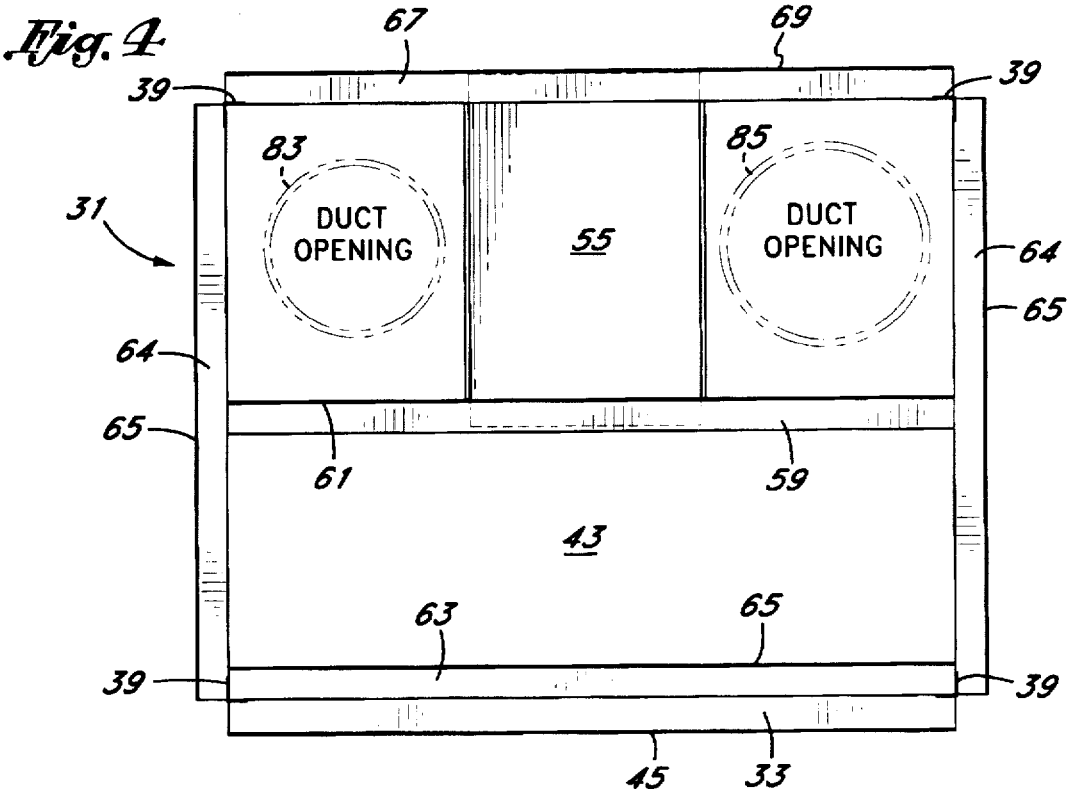
FIG. 4 is a top view of the upper portion of the curb illustrating the functioning of a spacer used between two duct openings.

Referring to FIG. 4, an underside view of the upper portion 31 is shown. Since FIG. 4 is an underside view, the reinforced corners 39 are clearly seen before the rails 63, 64 and 67. The lower lip 45 is shown as being significantly displaced from the vertical wall 33 of the upper portion 31.

Further details are seen, including the dashed outline of the forward and rear edges of the spacer plate 55. A pair of ducts 83 and 85 are designated with the terms "duct opening" and show a pair of different sized ducts which will either extend through or be sealed by the upper portion 31. Thus, in the case where small round ducts more easily extend from the equipment 23, such can be accomplished without additional sealing or the need for gasket 53 material. However, in cases where the ducts extending upwardly through the curb 21 can be sealed against the rectangular openings, the gasket sealing method can be used to advantage.

Figure 5:
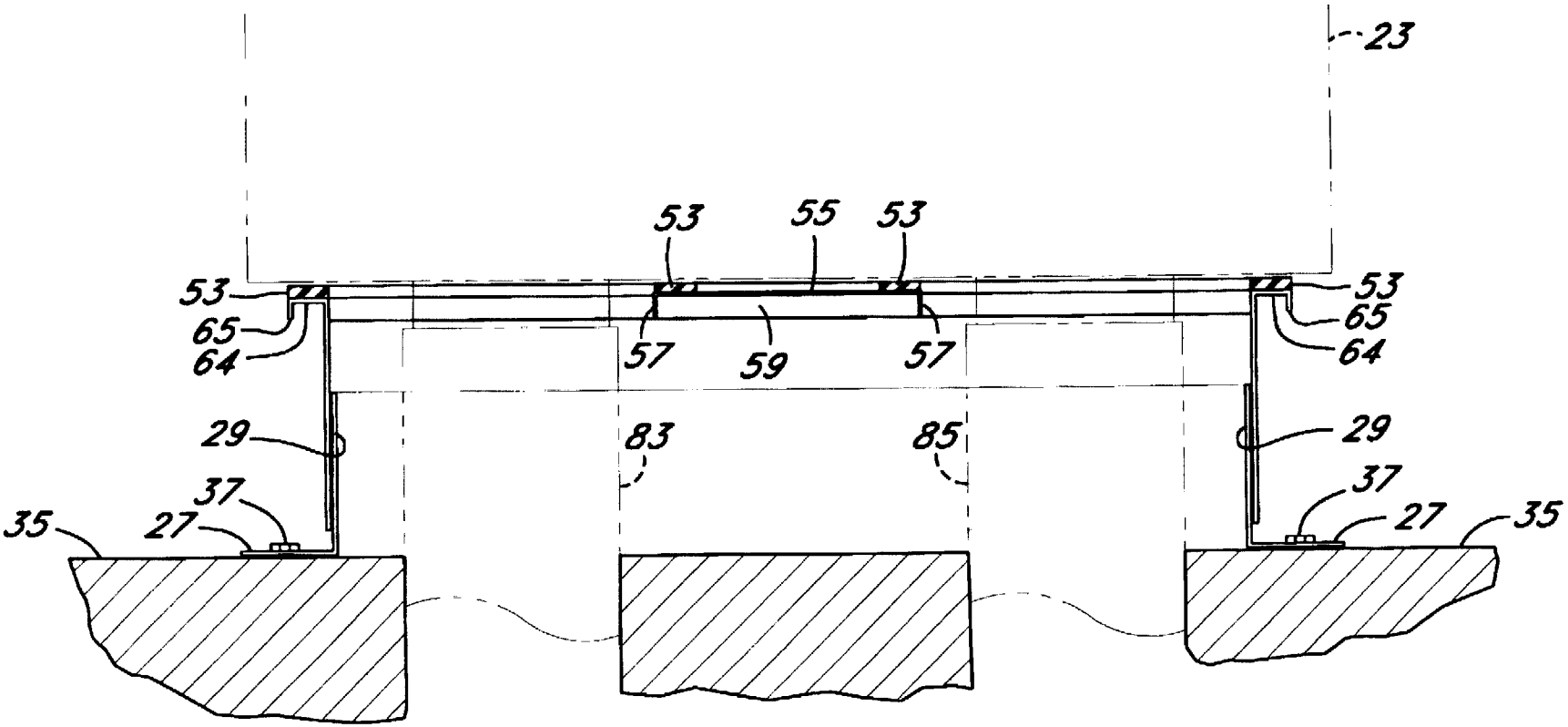
FIG. 5 is a side sectional view of the curb of the present invention and illustrating a pair of ducts, shown in phantom, as they fit into and through the curb and upward into a ventilation unit.

Referring to FIG. 5, a view taken along line 5—5 of FIG. 1 illustrates the relationship between the gasket 53 and the side rails 64 and the equipment 23 which sits upon the side rails 64. The ducts 83 and 85 are still shown in phantom to illustrate that the gasket 53 shown in FIG. 1 can still be used to seal the inner portions of the curb 21 against the outside weather even where such sealing is not necessary to sealably separate the ducts 83 and 85. Also shown in FIG. 5 is an additional pair of gasket members which are mounted above the spacer plate 55 to further isolate the two areas. Further, separator ducting can extend upwardly and sealably engage the spacer plate 55 where the upper portion 31 is used to support and seal against flow from between the channels.

Since the space between the vertical walls 29 of the base portion and vertical walls 31 of the upper portion are not sealed, any separator channel sealing will involve extension of the ducts to the top of the upper portion 31 to provide a sealed connection. The curb 21 as show does not pressure seal its general opening 59 against the outer atmosphere. Rather the design of the curb 21 is intended to keep out snow and rain and to promote corrosion free drainage and to minimize other latent losses from the space immediately beneath the curb 21.

Figure 6:
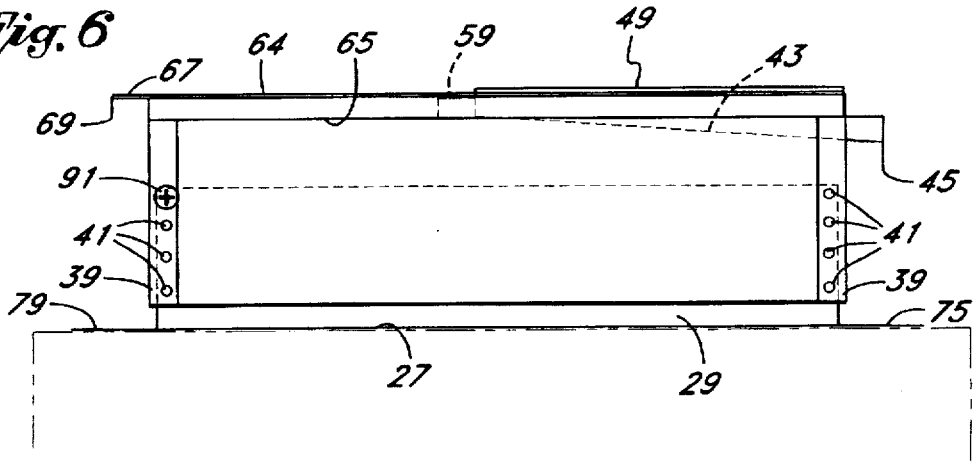
FIG. 6 is a first view illustrating the use of the curb on a flat surface.
Figure 7:
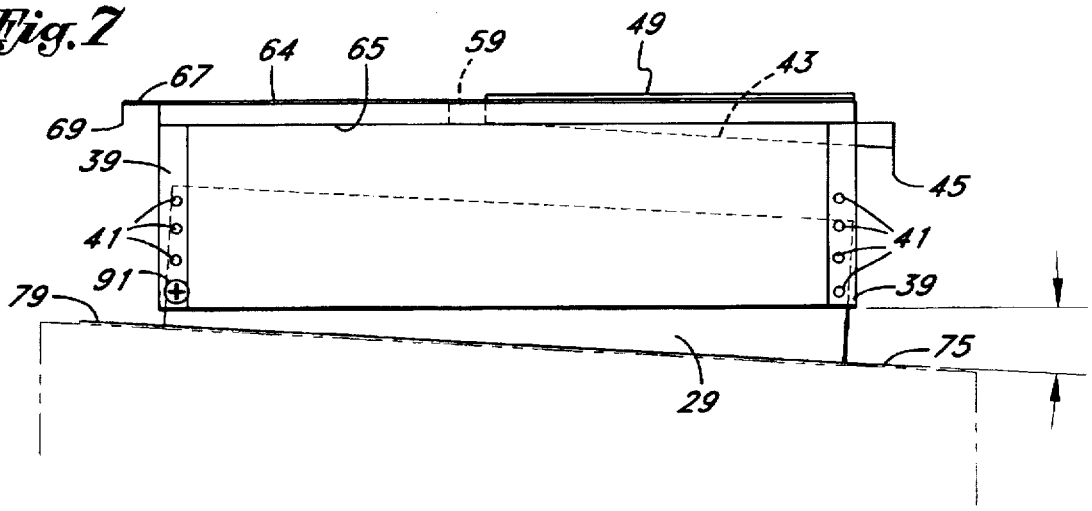
FIG. 7 illustrates the use of the curb on an angled roof surface.
Figure 8:
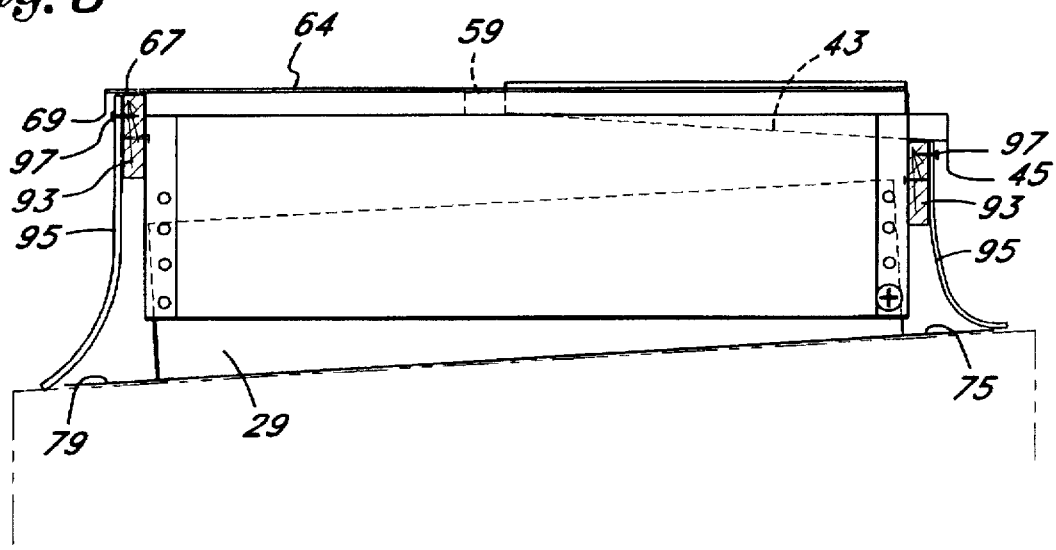
FIG. 8 illustrates a variation on the traditional roofing technique where the roofing material is nailed directly to wooden strips which are tucked underneath the lips of the curb.

The view of FIG. 5 was one of the curb 21 at rest, and in which the base portion 25 has not yet been connected to the upper portion. FIGS. 6–8 illustrate variations on installation techniques. In FIG. 6, the base portion is itself attached to a flat surface. As a result, the upper portion 31 can be displaced evenly and slightly upward to make sure that a closed space will not be formed between the lower section of the vertical wall 29 and the lower edge of the vertical wall 33 to trap water.

Even in this level to level application, the leveling process is similar to other more severe leveling configurations. A first, preferably self starting screw 91 is inserted through a pre-drilled hole 41 and through and into the vertical wall 29 of the base portion 25. This process may be facilitated by drilling a starter hole into the vertical wall 29. This process may also be facilitated by using supports fitted under lower edge of the upper portion 31 to hold one corner of the upper portion in place until the screw 91 is secured.

Once the screw 91 is secured, the upper portion 31 can still pivot about the screw 91. The opposite edge of the upper portion 31 can then preferably be supported and have another screw 91 similarly inserted opposite to the screw shown in FIG. 6. The back edge, along rail 67 would be leveled before the second screw is inserted in order to provide one measure of leveling. The front of the upper portion 31 is now ready for leveling, and since two rear screws are present to provide some pivot axis ability, the front of the upper portion 31 can be supported just beneath the lower lip 45, preferably at the center of lower lip 45, as the side rails and front rail is checked to be sure it is level. Screws 91 would then be inserted at the front and sides, through the holes, while holding the upper portion 31 level.

This technique is again used with regard to the configuration of FIG. 7 where the roof surface is slanted. The internal outline of the base portion 25 is shown in dashed line format and FIG. 7 illustrates how the upper and lower edges of the base portion begin to impinge the internal surface of the vertical walls 33.

In this situation, the rear screws should be placed low so that the rear pivot will be low to enable pivoting rather than binding to take place. After the rear rail 67 is leveled, the front lower lip 45 can be supported at the middle, or with separate supports to each side until all of the other upward surfaces are leveled. Screws 91 would then be inserted at the remaining holes 41 and into the vertical wall 29 to secure the curb 21.

FIG. 8 illustrates a rearward tilted surface along with the use of conventional roofing material to finish the job. Wood slats 93 can be jammed or glued, or even screwed into the vertical wall 33 of the upper portion 31, and preferably just under the rails 67 and the lower lip of the pitch pan 43. The same procedure described above for FIGS. 6 and 7 are followed for leveling, except that the first screw 91 is placed at the forward end of the curb 21 since the forward end is to be lower than the rear end.

Once the slats 93 are added, sheets of roofing 95 are laid against the slats 93, and preferably tucked underneath the lips 45 and 69, and may be fixably nailed with roofing nails 97.

Figure 9:
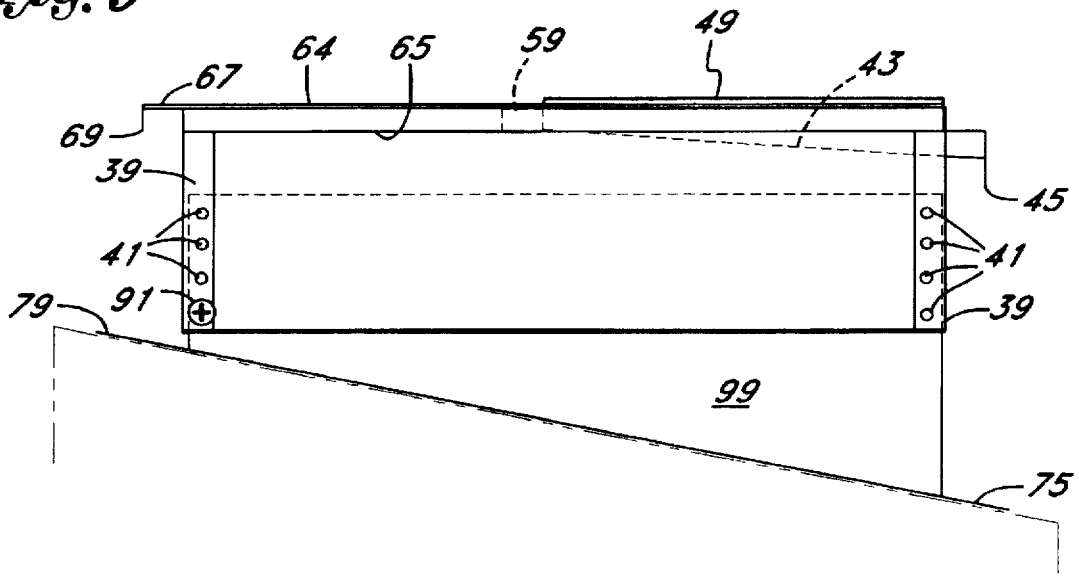
FIG. 9 illustrates the use of the curb of the present invention on a very steep section of roofing where the base is modified to give an upwardly vertical extension upon which a top portion can still be leveled in order to complete the installation.

FIG. 9 illustrates the curb of the present invention with a base 99 which has a vertical axis intersecting the flange 27 which has been angularly tilted to horizontally match the pitched roof. This configuration is especially needed if the pitch exceeds a pitch of about 10:1. The upper edges of the vertical walls of the base 99 form a horizontal plane. The upper portion 31 will then be leveled with respect to the base 99 in a manner as was described earlier. The same degree of leveling and fine tuning is now achievable since the grossest portion of the steep pitch correction has been taken care of in a specialized base 99.

While the present invention has been described in terms of a curb, as well as processes for making, using and installing the curb one skilled in the art will realize that the structure and techniques of the present invention can be applied to many appliances. The present invention may be applied in any situation where level support and weather isolation is to be created.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A curb comprising:

a base portion having a plurality of vertical walls, each vertical wall having an associated flange portion;

an upper portion having a plurality of vertical walls bounded on their upper portion by associated rails, and defining a plurality of holes in said vertical walls of said upper portion to facilitate attachment to said vertical walls of said base portion; and a pitch pan attached to said upper portion and supported by said rails, and defining pitch pan surface sloped with respect to said rails and terminating in a lower lip extending over and beyond a vertical wall of said upper portion.

2. The curb as recited in claim 1 wherein each of said flange portions lies adjacent another one of said flange portions to form an adjacent pair of flange portions and wherein each adjacent pair of flange portions of said base portion are joined with a cap portion which overlies a section of said adjacent pairs of flange portions.

3. The curb as recited in claim 1 wherein a vertical wall of said base has an edge portion attached to an adjacent vertical wall.

4. The curb as recited in claim 1 wherein said rails are formed from said vertical walls of said upper portion by a first right angled bend adjacent said vertical wall to form a horizontal rail surface and a second right angled bend adjacent said rail surface and forming a downwardly extending lip.

5. The curb as recited in claim 4 wherein said upper portion of one of said vertical walls of said upper portion extends inwardly to accommodate said lower lip of said pitch pan.

6. The curb as recited in claim 4 wherein said rails extend outwardly of the vertical walls of said upper portion.

7. The curb as recited in claim 1 and further comprising reinforced corners attached to adjacent pairs of said plurality of vertical walls of said upper portion.

8. The curb as recited in claim 5 wherein said reinforced corners have pre-drilled holes extending through said reinforced corners and a portion of the vertical walls of the upper portion which said reinforced corners overlie.

9. The curb as recited in claim 1 wherein said pitch pan has a rear rail opposite and parallel to said lower lip and adjacent an uppermost edge of said sloped surface and a pair of horizontal side rails which overlie and are supported by said rails of said upper portion.

10. The curb as recited in claim 9 wherein said rear rail of said pitch pan has a height is nearly the same as a height of said rails of said upper portion and wherein said rear rails and said rails of said upper portion form a border of a rectangular opening in said upper portion.

11. The curb as recited in claim 10 and further comprising gasket material supported by said rails of said upper portion and said pitch pan.

12. The curb as recited in claim 10 and further comprising a spacer plate having a first end supported by said rear rail and a second opposite end supported by a rail of said upper portion, said spacer plate covering a portion of said opening of said upper portion.

13. The curb as recited in claim 12 and wherein said spacer plate has a pair of downwardly directed side lips having pairs of end edges including one of said pairs of end edges which abut an inner edge of said rear rail and the other one of said pairs of end edges which abut an inner edge of said rail of said upper portion and prevent said spacer plate 55 from sliding in a longitudinal direction to enable said spacer plate to fall into said opening.

14. The curb as recited in claim 13 and further comprising gasket material supported by said rails of said upper portion and said pitch pan, and across the a first and second opposite ends of said spacer plate.

15. The curb as recited in claim 1 and wherein said vertical walls have upper edges, and where the upper edges of the vertical walls have a plane orientation and wherein said flange portion is angled with respect to said plane of said upper edges of said vertical walls.

* * * * *